US009932139B2

(12) United States Patent
Scott et al.

(10) Patent No.: US 9,932,139 B2
(45) Date of Patent: Apr. 3, 2018

(54) DISPENSER

(71) Applicant: NERUDIA LTD., Liverpool (GB)

(72) Inventors: Kenneth Scott, Liverpool (GB); Chris Lord, Liverpool (GB); David Jones, Liverpool (GB); Stephen McDonald, Liverpool (GB)

(73) Assignee: Nerudia Ltd., Liverpool (GB)

( * ) Notice: Subject to any disclaimer, the term of this patent is extended or adjusted under 35 U.S.C. 154(b) by 0 days.

(21) Appl. No.: 14/969,308

(22) Filed: Dec. 15, 2015

(65) Prior Publication Data

US 2016/0167826 A1 Jun. 16, 2016

(30) Foreign Application Priority Data

Dec. 15, 2014 (GB) ..... 1422317.6
Dec. 9, 2015 (GB) ..... 1521722.7

(51) Int. Cl.
*B65D 47/04* (2006.01)
*B65D 1/32* (2006.01)
(Continued)

(52) U.S. Cl.
CPC ..... *B65D 1/323* (2013.01); *B65D 1/0223* (2013.01); *B65D 25/38* (2013.01); *B65D 43/02* (2013.01);
(Continued)

(58) Field of Classification Search
CPC ..... B65D 1/323; B65D 1/32; B65D 1/0223; B65D 25/38; B65D 43/02; B65D 1/326; B65D 47/2056; B65D 47/283
(Continued)

(56) References Cited

U.S. PATENT DOCUMENTS 2,095,622 A * 10/1937 Wilson ..... B65D 47/283 222/215
2,155,202 A * 4/1939 Parvis ..... B65D 35/40 222/336
(Continued)

FOREIGN PATENT DOCUMENTS

DE 1003622 B 2/1957
EP 0106941 A2 7/1983
(Continued)

OTHER PUBLICATIONS

Combined Search and Examination Report for United Kingdom Application No. GB1521722.7, dated Feb. 26, 2016, 4 pages.
(Continued)

*Primary Examiner* — Charles P Cheyney
(74) *Attorney, Agent, or Firm* — Sheppard Mullin Richter & Hampton LLP

(57) ABSTRACT

A dispenser for dispensing a liquid is disclosed. The dispenser comprises an outlet for dispensing a liquid, a reservoir for liquid, and a closure configured to engage with the dispenser and movable between a closed position in which the outlet is enclosed and an open position in which the outlet is not enclosed. The dispenser further comprises an arrangement for controlling liquid communication between the reservoir and the outlet, the arrangement and reservoir movable with respect to each other between a first configuration in which the reservoir is not in liquid communication with the outlet and a second configuration in which the reservoir is in liquid communication with the outlet. By requiring a second movement after removal of the closure accidental access or dispensing of the contents may be avoided or reduced.

9 Claims, 8 Drawing Sheets

(51) Int. Cl.
*B65D 47/28* (2006.01)
*B65D 1/02* (2006.01)
*B65D 25/38* (2006.01)
*B65D 43/02* (2006.01)

(52) U.S. Cl.
CPC .... *B65D 47/283* (2013.01); *B65D 2501/0081* (2013.01)

(58) Field of Classification Search
USPC ..... 222/514, 519–525, 153.4, 182, 206–215
See application file for complete search history.

(56) References Cited

U.S. PATENT DOCUMENTS 2,901,153 A * 8/1959 Collins ..... B65D 47/247 222/525
2,914,222 A * 11/1959 Meshberg ..... B65D 83/386 222/153.11
2,966,283 A * 12/1960 Darvie ..... B65D 83/386 222/162
3,245,587 A * 4/1966 Brown ..... B65D 47/283 222/182
3,759,429 A * 9/1973 Ardito ..... B65D 47/283 222/546
4,949,876 A * 8/1990 Schneider ..... B05B 11/3028 222/207
5,226,563 A * 7/1993 Coggiola ..... B05B 11/0027 222/153.01
5,433,343 A * 7/1995 Meshberg ..... A61M 15/08 222/154
8,052,016 B2 * 11/2011 Wang ..... B65D 35/22 220/526
8,336,790 B2 * 12/2012 Kolins ..... A61L 9/042 222/206
8,360,281 B2 1/2013 DeJonge
8,439,232 B2 5/2013 Laidler
8,544,664 B2 10/2013 Dejonge
8,584,903 B2 11/2013 DeJonge
8,646,658 B2 * 2/2014 Bae ..... A45D 34/02 222/182
2010/0133301 A1 * 6/2010 Chan ..... B65D 47/283 222/402.1
2012/0187151 A1 7/2012 DeJonge

FOREIGN PATENT DOCUMENTS

EP 0329582 A1 8/1989
WO 0136289 5/2001
WO 2004020324 A2 3/2004
WO 2006119612 11/2006
WO 2010048465 A1 4/2010
WO 2011102694 A2 8/2011
WO 2014027830 2/2014

OTHER PUBLICATIONS

International Search Report and Written Opinion of the International Searching Authority for International Application No. PCT/EP2015/079671, dated Apr. 29, 2016, 12 pages.
International Search Report and Written Opinion of the International Searching Authority for International Application No. PCT/EP2015/079672, dated Mar. 4, 2016, 13 pages.
Search Report for United Kingdom Application No. GB1422317.6, dated Jun. 23, 2016, 3 pages.

* cited by examiner

DISPENSER

FIELD

The present invention relates to a dispenser for dispensing a liquid. In particular, but not exclusively, the present invention relates to a dispenser for dispensing a dangerous liquid such as a poisonous or toxic liquid.

BACKGROUND

Dispensers for dangerous liquids generally include a safety feature associated with the lid or cap of the dispenser which inhibits removal of the lid or cap by requiring a sequence of movements or simultaneous movements to be performed on the lid or cap in order to remove it. Typically the movements are difficult to perform, for example because two movements in transverse or naturally opposing or counterintuitive directions are required simultaneously. Such safety features are generally referred to as "childproof" or "child resistant" since they were developed in order to inhibit a child's access to dangerous contents within a bottle such as medicines whether in solid or liquid form. However, children may learn to remove such "child resistant" lids or caps and users having weak hand strength such as the aged or infirm may be unable to remove "child resistant" lids or caps. Perversely, this leads to some users leaving the lids or caps off the bottles or at least in an intermediate configuration which is not childproof and easy to remove thereby making the content accessible to children or other persons who may be not aware of the dangerous nature of the contents of the bottle.

A study from the US Centre For Disease Control and Prevention dated 3 Apr. 2014 reported that more than half (51.1%) of calls to poison centres due to E-cigarettes involved young children under the age of 5, and about 42% of the poison calls involved people aged 20 and older.

Aspects and embodiments in accordance with the present invention were devised with the foregoing in mind.

SUMMARY

Viewed from a first aspect there is provided a dispenser for dispensing a liquid, comprising:

an outlet for dispensing a liquid;

a reservoir for liquid; and a closure configured to engage with the dispenser and movable between a closed position in which the outlet is enclosed and an open position in which the outlet is not enclosed;

the dispenser further comprising an arrangement for controlling liquid communication between the reservoir and the outlet, the arrangement and reservoir movable with respect to each other between a first configuration in which the reservoir is not in liquid communication with the outlet and a second configuration in which the reservoir is in liquid communication with the outlet; and a housing for the reservoir, the reservoir translatable with respect to the housing to bring the reservoir into liquid communication with the outlet, wherein the housing is configured to permit the closure, while the closure is in the open outlet position, to engage with the reservoir for urging the arrangement from the first configuration to the second configuration for bringing the reservoir into liquid communication with the outlet.

In such an embodiment, the closure is configured to engage with the housing for removably retaining the closure in a closed outlet position. Suitably, the closure and the housing comprise mutually cooperative engagement formations configured for removably retaining the closure in a closed outlet position.

Such a dispenser requires at least two separate activities in order to gain access to the contents of the dispenser. Furthermore, once the first activity, i.e. removal of the closure has been completed, access to the contents of the dispenser is still inhibited. Dispensing the contents requires a specific action deliberately to dispense the contents. Thus, inadvertent dispensing of contents may be reduced or avoided.

Suitably, the housing comprises an aperture configured to permit the closure to engage with the reservoir. In a particular arrangement, the closure comprises an engagement member configured to engage with the reservoir for urging the arrangement into the second configuration. Typically, the engagement member is disposed in the interior of the closure.

In at least one embodiment the arrangement forms a valve assembly for controlling liquid communication between the reservoir and the outlet and operative to permit liquid communication between the reservoir and the outlet responsive to relative movement of the outlet with respect to the reservoir. A valve is a suitable arrangement for controlling the flow of a liquid.

The arrangement may comprise a conduit including a first aperture in a wall of the conduit, the reservoir including a second aperture complementary to the first aperture, and wherein in the first configuration the conduit is disposed such that the wall occludes the second aperture and in the second configuration the first aperture opposes the second aperture to permit liquid communication therebetween. Suitably the reservoir and conduit are slideably movable with respect to each other between the first and second configuration.

Synergistically, the reservoir includes a guide for guiding movement of the conduit between the first and second configuration and the guide may provide the wall in which the second aperture is provided.

Typically, the guide is tubular and may extend into the reservoir. Suitably, the guide extends along a side of the reservoir.

In at least one embodiment an end of the conduit comprises the outlet.

The arrangement may be constrained to be movable between the first and second configuration only while the closure is in the open position which reduces the likelihood of accidental dispensing or spillage of contents. Such accidents may be further reduced by the closure being configured to engage with the reservoir for removably retaining the closure in a closed outlet position.

In at least one embodiment, the outlet is mounted on a plug member insertable to an open end of the reservoir, the plug member comprising the arrangement and movable with respect to the reservoir from the first configuration to the second configuration.

Suitably, the closure and the reservoir comprise mutually cooperative engagement formations configured for removably retaining the closure in a closed outlet position.

The closure may further comprises an occlusion member in its interior configured to occlude the outlet while the closure is in the closed position. In this way, further accidental spillage leakage of the content of the dispenser may be avoided or the likelihood reduced.

Synergistically, the engagement member is configured to occlude the outlet when the closure is in the closed position.

In one or more embodiments the reservoir is configured to permit pressure to be exerted on a liquid in the reservoir to dispense liquid from the outlet. In certain embodiments the housing is deformable to permit pressure to be exerted on a liquid in the reservoir.

One or more embodiments may comprise a bias mechanism configured to bias the reservoir away from the second configuration. Such an arrangement maintains the reservoir out of liquid communication with the outlet unless a positive pressure is applied to bring them into liquid communication thereby reducing the likelihood of leakage and accidental dispensing of contents. Suitably, the bias mechanism is fixed at one end to the closure.

In one or more embodiments the housing comprises an end cap supporting the outlet and the arrangement. Typically, the end cap is removably attached to the housing.

In one or more embodiments, the mutually cooperative engagement formations comprise a détente arrangement movable between an engaged and disengaged position, wherein in the engaged position the closure is retained in the closed outlet position and in the disengaged position the closure is movable to the open outlet position. Suitably, the mutually cooperative engagement formations are arranged to provide a "child resistant" release mechanism. For example, the mutually cooperative engagement formations are arranged to provide a squeeze and pull release mechanism.

LIST OF FIGURES

One or more embodiments in accordance with the present invention will now be described, by way of example only, and with reference to the accompanying drawings in which.

Figure 4:
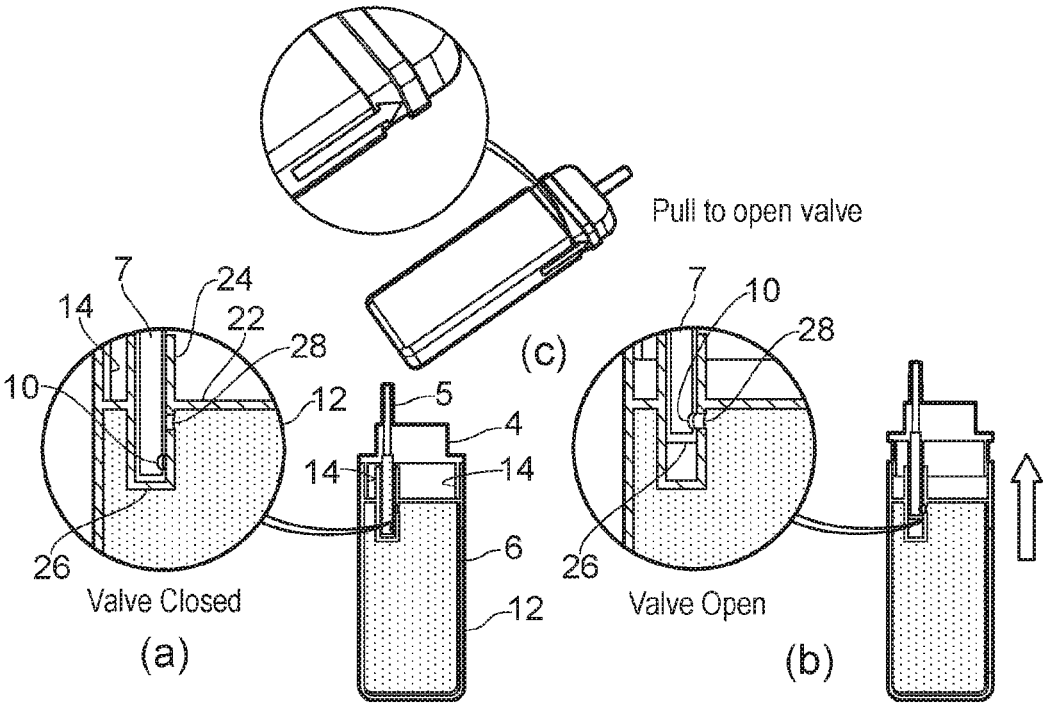
Figure 5:
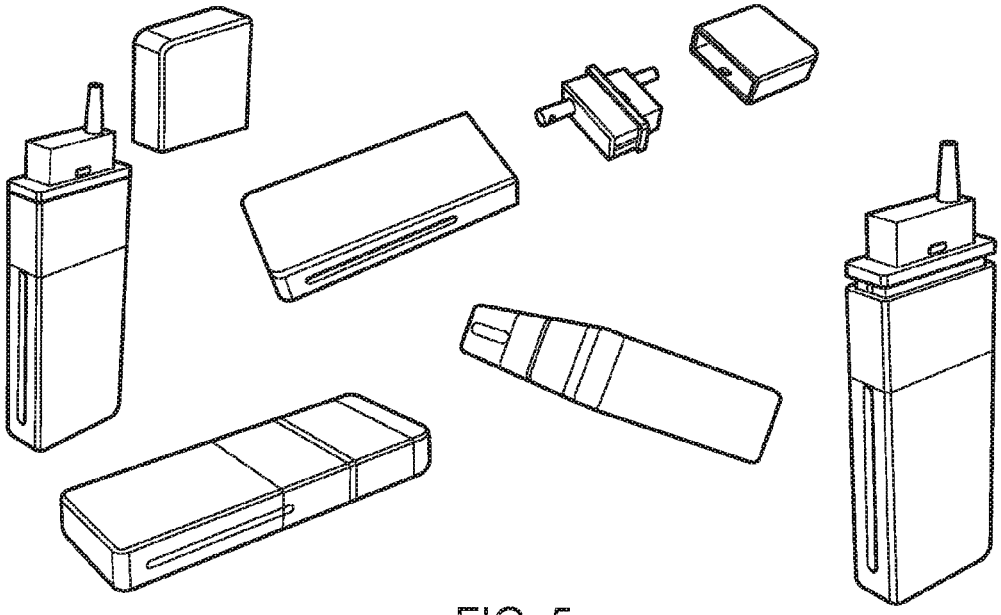
Figure 6:
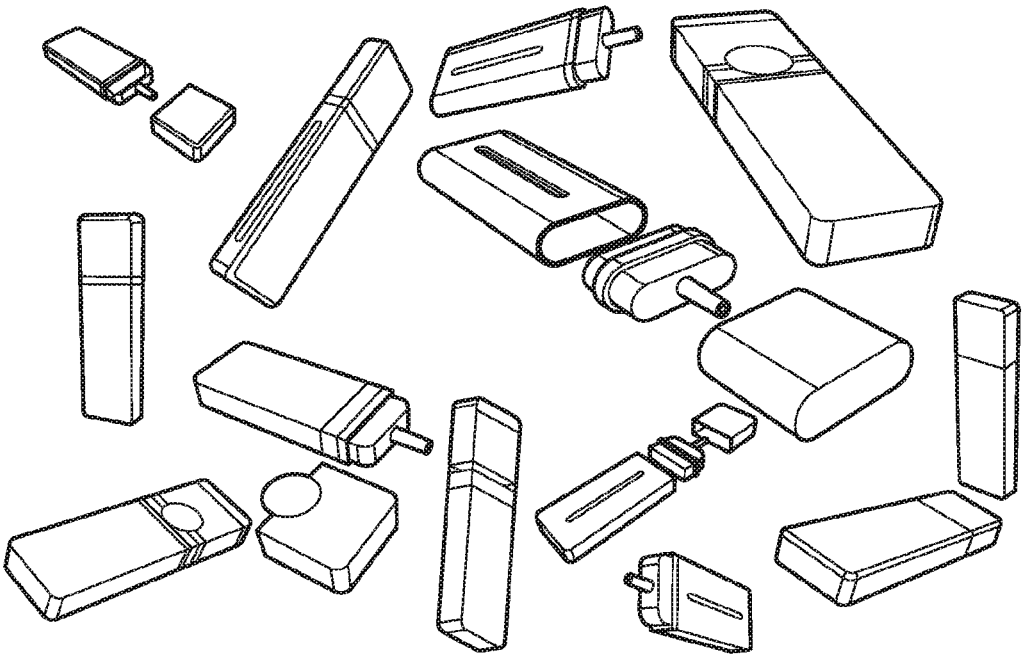
Figure 7:
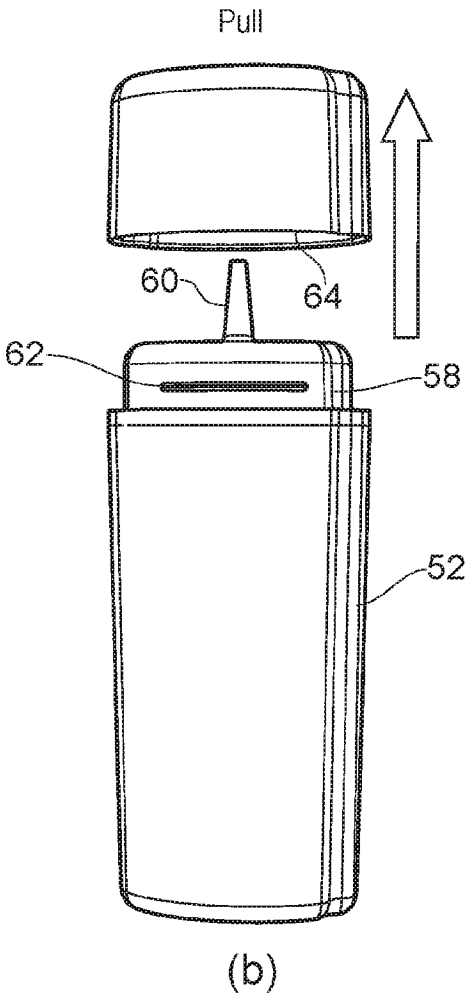
Figure 7:
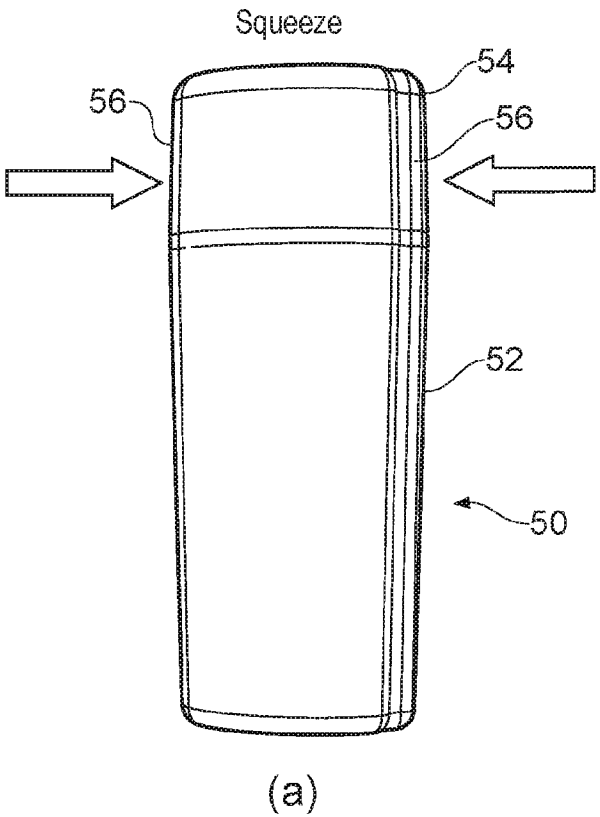
Figure 8:
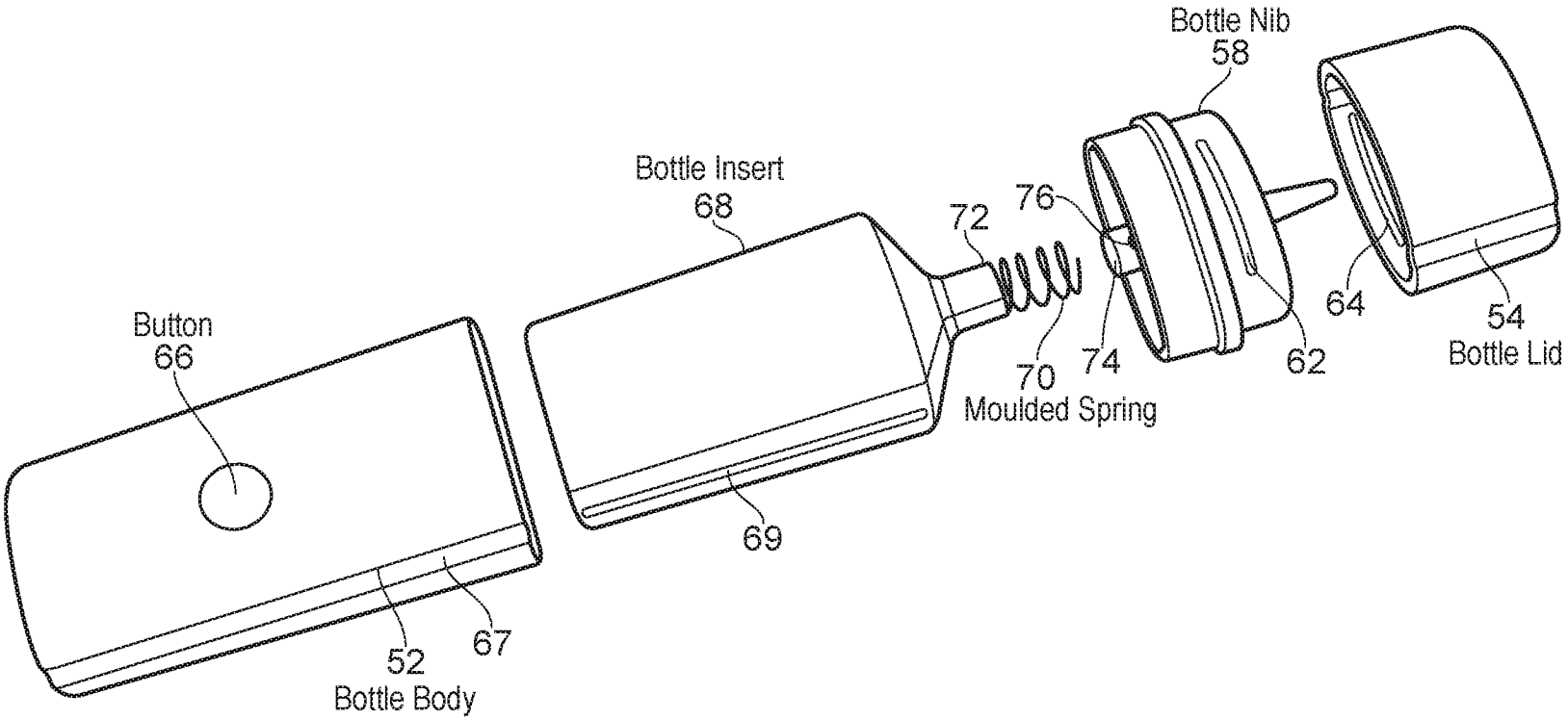
Figure 10:
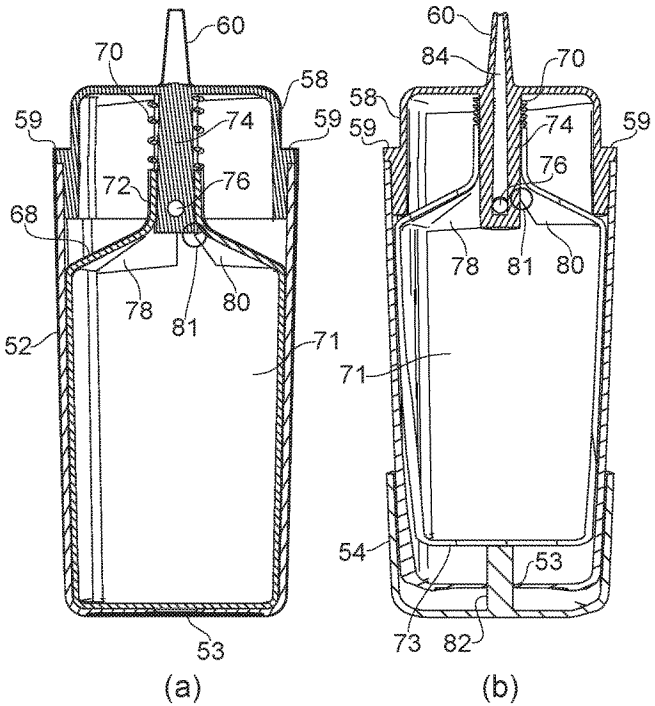
Figure 9:
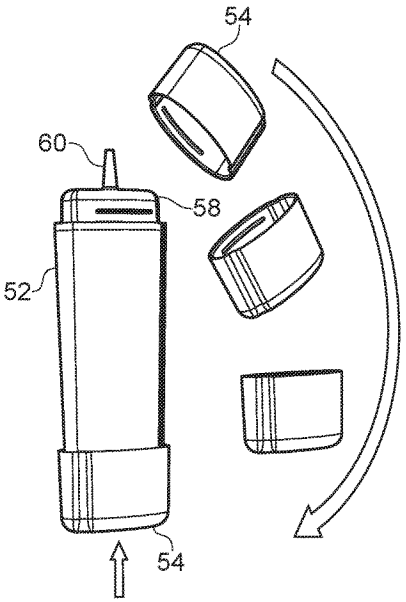
Figure 11:
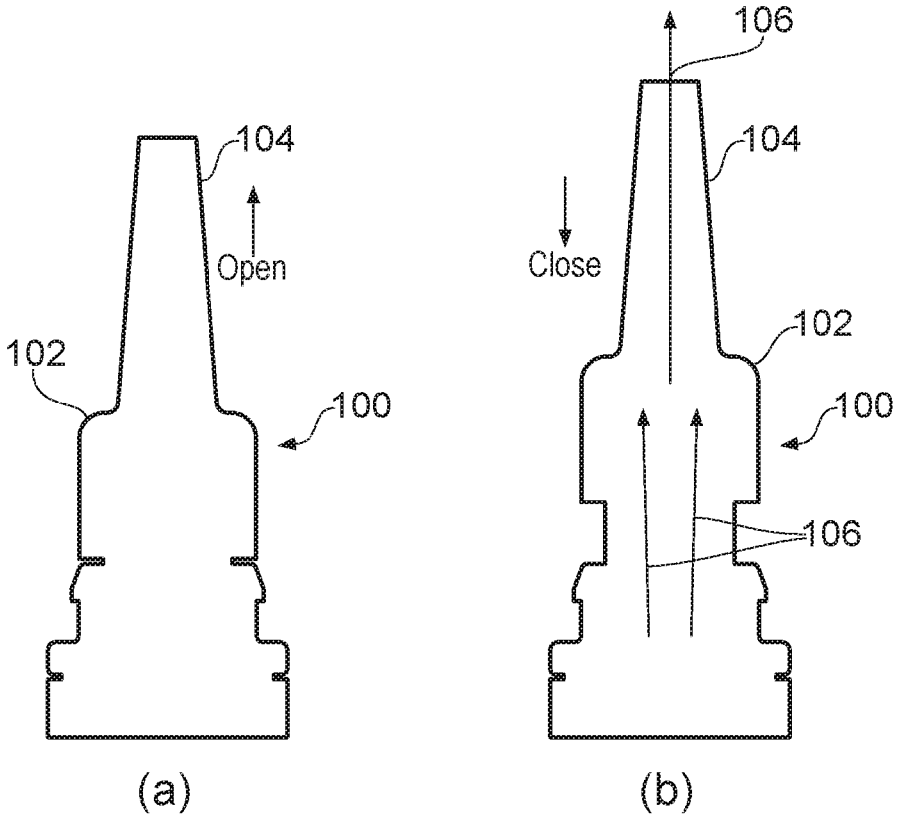
Figure 12:
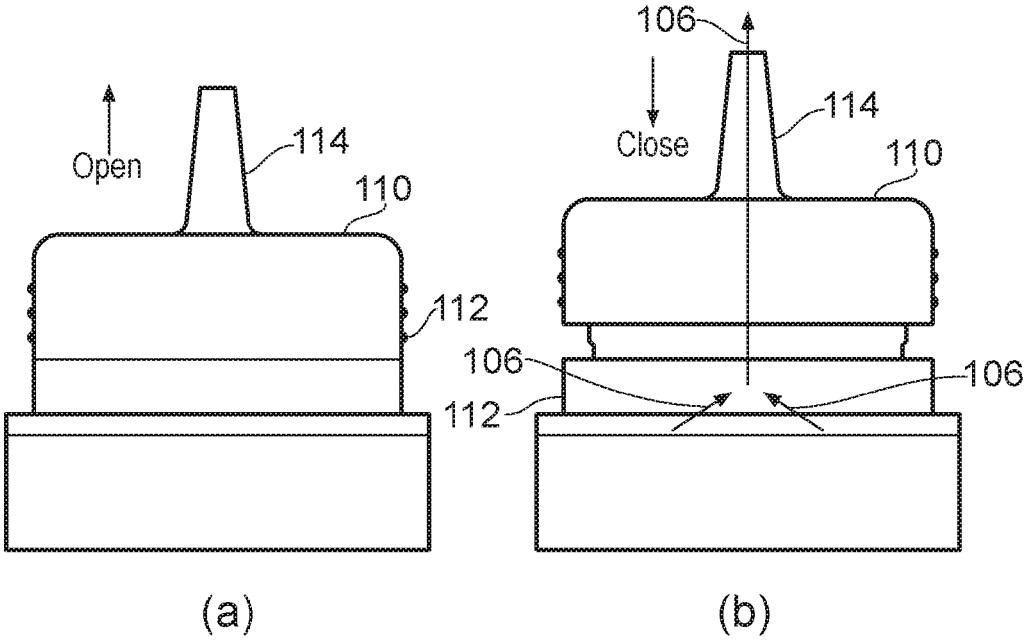

FIG. 4 schematically illustrates crossectional views of (a) the valve in its closed configuration and (b) the valve in its open configuration, and (c) a perspective view showing the valve partway between its open and closed configurations;

FIG. 5 shows various schematic illustrations of different shaped dispensers in accordance with the embodiments of the present invention;

FIG. 6 shows yet further various schematic illustrations of different shaped dispensers;

FIG. 7 schematically illustrates two views of an embodiment of a dispenser in accordance with the present invention in which view (a) shows the dispenser with a lid on and view (b) shows the dispenser with the lid pulled off;

FIG. 8 shows an exploded view of the embodiment of the dispenser in accordance with the present invention;

FIG. 9 shows a schematic representation of the lid of a dispenser being placed at its base in operation of the embodiment of the dispenser in accordance with the present invention;

FIG. 10 shows a first view (a) of a cross-section through an aperture in the conduit of a valve member of the embodiment of the dispenser in accordance with the present invention and the second view (b) of a cross-section through the centre of the embodiment of the dispenser in accordance with the present invention;

FIGS. 11(*a*) and (*b*) are schematic illustrations of a stopper arrangement suitable for a dispenser as illustrated in FIGS. 1 to 6; and FIGS. 12(*a*) and (*b*) are schematic illustrations of a further stopper arrangement suitable for a dispenser as illustrated in FIGS. 1 to 6.

DESCRIPTION

Figure 1:
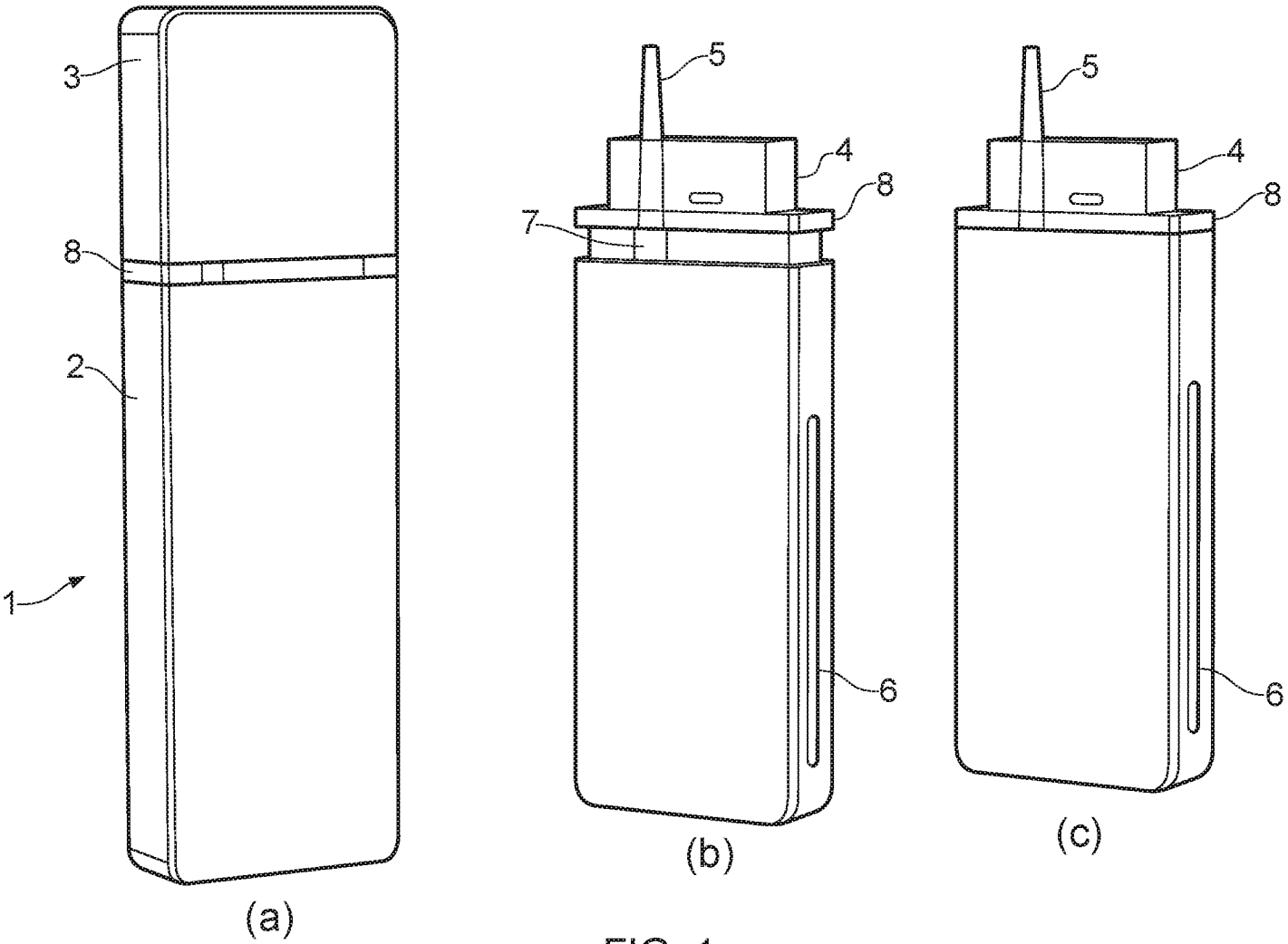
FIG. 1 illustrates three views of a dispenser, in which the first view (a) shows a dispenser with the lid attached in a closed position; the second view (b) shows the dispenser with the lid removed (open position) and a movable valve in an open position; and a third view (c) showing the movable valve in the closed position.

Referring now to FIG. 1, a dispenser 1 comprises a reservoir 2 and a cap or lid 3, hereinafter a lid. The dispenser 1 also includes a valve member 4 movable to bring the reservoir into fluid communication with an outlet 5. Valve member 4 comprises a lip 8 which provides a stop to inhibit the valve 4 being pushed too far into reservoir 2. Additionally, it may also be used to provide a convenient feature which may be gripped between the user's fingers when pulling the valve 4 open.

As can be seen in FIG. 1, view (b) and view (c) the valve member 4 supports an outlet 5 which in the described embodiment forms a tapered spout for controlled delivery of a liquid. Also illustrated in FIG. 1, view (b) and view (c) is a transparent viewing window 6 through which the level of the contents in reservoir 2 may be viewed. A conduit member 7 of valve 4 is shown in FIG. 1, view (b) and can be seen to extend from the valve member 4 into the interior of reservoir 2. The conduit member 7 is in liquid communication with outlet 5 and since both the outlet 5 and conduit member 7 are mounted on a valve member 4 they move together such that any liquid entering into conduit member 7 may flow to outlet 5. In the described embodiment the lower part of valve member 4 is made of a transparent material, e.g. a transparent plastics material and conduit member 7 is made from an opaque material e.g. an opaque plastics material hence its visibility in FIG. 1. Naturally, such a configuration is convenient for illustrative purposes but the person of ordinary skill in the art will understand that the function of the device is not dependent upon whether or not one or more parts are transparent or opaque and all parts may be opaque or indeed transparent or any combination thereof.

Figure 2:
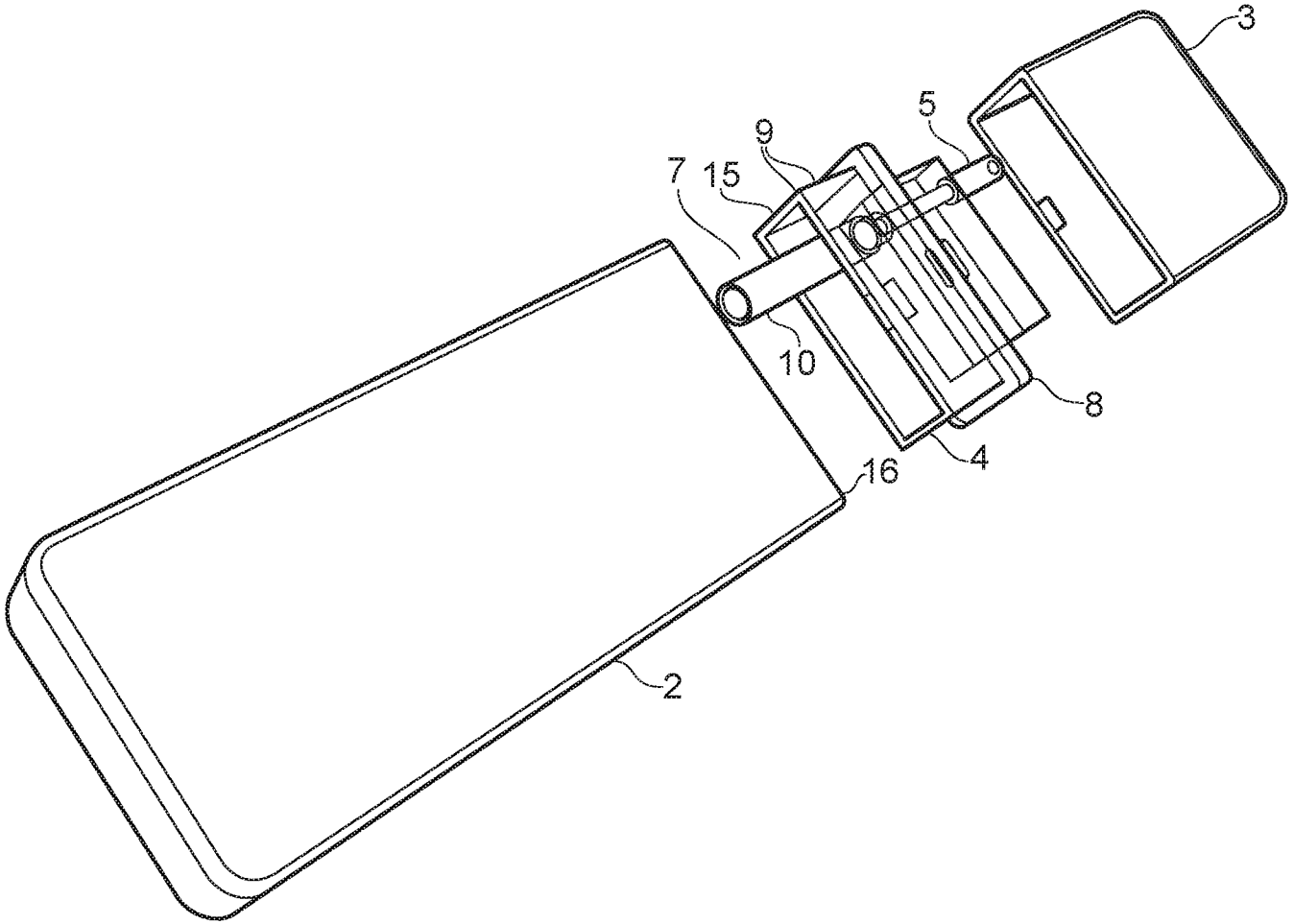
FIG. 2 illustrates a perspective "exploded" view of the dispenser illustrated in FIG. 1.
Figure 3:
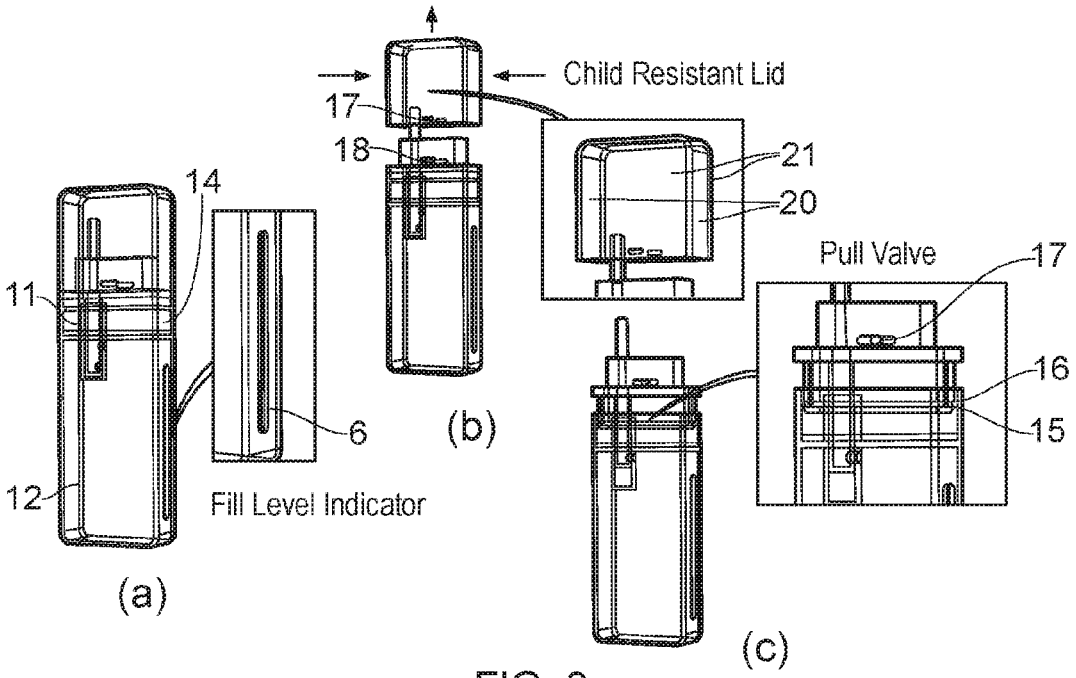
FIG. 3 illustrates "wire frame" views in which view (a) shows the dispenser with the lid on the reservoir, view (b) shows the lid removed and view (c) shows the lid removed and the valve pulled to its open position.

Referring now to FIG. 2, the valve member 4 may be seen completely removed from reservoir 2, the lid 3 also being separated from the valve member 4. Conduit member 7 includes an aperture 10 towards the end of the conduit member 7 which is inserted into reservoir 2. Conduit member 7 is also closed at the end inserted into reservoir 2. Valve member 4 also includes an interior lip member 15 which may be engaged with a corresponding stop member 16 located around the upper periphery of reservoir 2 to inhibit valve member 4 from being drawn out of the reservoir 2 completely.

Valve member 4 is slidable between its open and closed configurations in close cooperation with the interior sides 14 of reservoir 2 that extend beyond the storage cavity of reservoir 2. In the described embodiment slidable close cooperation is achieved by protruding tongue members 9 disposed at the sides of valve member 4 which slide within cooperatively disposed grooves 11 located on the interior sides 14 of reservoir 2 extending beyond the storage cavity 12. Optionally, the tongue members 9 do not run in corresponding grooves but engage with the interior sides 14 of the protruding part of the reservoir sidewalls. For example, the tongue members 9 may be inclined so as to form a wedge thereby firmly engaging the valve member 4 with the reservoir 2 but allowing the valve member 4 to be drawn away from the reservoir 2 cavity into the valve member 4 open configuration.

Lid 3 is made of a deformable material such as a medium density plastics material such as polypropylene and the like, and also includes a cavity 17 which is shaped to accommodate protrusion 18. When the lid 3 is pushed onto valve member 4 the wall of the lid encountering protrusion 18 deforms sufficiently for the lid to pass over protrusion 18 until protrusion 18 engages with cavity 17 to releasably couple the lead to the valve member 4. The lid may be removed by simply squeezing the side walls 20 thereby causing the sidewalls 21 in the vicinity of cavity 17 to move outwards away from valve member 4. Movement of sidewalls 21 away from valve member 4 release protrusion 18 from cavity 17 thereby permitting lid 3 to be removed.

Turning now to FIG. 4 a cross-section of dispenser 1 with valve member 4 in the closed position is illustrated in FIG. 4, view (a). The storage cavity 12 of reservoir 2 is formed of the sidewalls of the reservoir and a top wall 22. Extending through top wall 22 is a tubular guide 24 in which conduit member 7 slides. Tubular guide 24 is closed at one end 26 and also includes a guide wall aperture 28 exposed to the interior of storage cavity 12. As schematically illustrated in FIG. 4, view (c), valve member 4 may be pulled to open the valve into the valve member open position illustrated in cross-section in FIG. 4, view (b).

In the valve member 4 open position aperture 10 in conduit member 7 is positioned opposite guide wall aperture 28 to provide a liquid communication path between the storage cavity 12 of reservoir 2 and the interior of conduit member 7. Thus, liquid stored in reservoir 2 may flow through apertures 28 and 10 into the interior of conduit member 7 and subsequently to outlet 5. In the described embodiment the walls of reservoir 2 are made of a deformable material such as a deformable plastics material and therefore may be squeezed to apply pressure to liquid stored in cavity 12 thereby forcing the liquid through apertures 28 and 10 onward through the interior of conduit member 7 to outlet 5 for dispensing of the liquid.

Such an arrangement comprises two safety features. The second safety feature is only accessible once the first or primary safety feature has been removed. A simple single direction operation, i.e. pulling the valve member 4 away from the reservoir into the open position creates a liquid path between the reservoir cavity 12 and the outlet 5 so that liquid stored in the reservoir cavity 12 may be dispensed.

Referring now to FIG. 7, view (a) an embodiment in accordance with the present invention is schematically illustrated in which a dispenser 50 comprises a housing 52 and a lid 54 attached to the housing 52. The second embodiment incorporates a primary child resistance feature which requires squeezing of the sides 56 of lid 54 to release lid 54 from the housing 52.

Referring now to FIG. 7, view (b) the valve member 58 is disposed at one end of housing 52 and includes an outlet 60. The valve member 58 also includes an engagement member 62 which cooperates with complementary engagement member 64 located on the interior of lid 54 to releasably lid 54 to the valve member 58 and thus housing 52. Releasing lid 54 allows the lid to be pulled away from the housing 52. The engagement members 62 and 64 may be a cavity and protrusion respectively or a protrusion and cavity respectively or indeed a combination of both.

An exploded view of the dispenser in accordance with the embodiment of the present invention is schematically illustrated in FIG. 8. Housing 52 may be considered to be a "bottle body" and is open at one end to receive reservoir 68 which may be considered to be a "bottle insert". Reservoir 68 is formed of a deformable material such as a plastics, for example polypropylene, so that one or more sides of the reservoir 68 may be squeezed together to expel liquid in the reservoir cavity out of the cavity. Likewise, housing 52 is also made of a deformable material such as polypropylene so that it may be deformed, for example by pressing a region of the housing, button 66, which is likely to produce the greatest squeezing effect on reservoir 68 when inserted in the housing 52.

In the described embodiment, housing 52 and reservoir 68 have transparent sections 67 and 69 respectively in order for a user to see the amount of liquid in the reservoir 68. Additionally, reservoir 68 includes a moulded spring 70 which in the described embodiment is attached to a neck 71 of reservoir 68. Valve member 58, sometimes referred to as a "bottle nib" includes an engagement member 62. Valve member 58 also includes a conduit member 74 which includes an aperture 76. Moulded spring 70 is configured such that conduit 74 may be inserted through the helix forming the spring 70 so that the spring 70 may abut the top of the interior of valve 58 or some other feature against which the moulded spring 70 may abut. As illustrated in FIG. 8, lid 54 includes engagement member 64 which is complementary to engagement member 62 for into engaging therewith.

FIG. 9 of the accompanying drawings schematically illustrates the sequence for using a dispenser in accordance with the embodiment of the invention. Lid 54 is released from housing 52 and valve member 58 to expose outlet 60. Lid 54 is placed over the opposite end of housing 52 to valve member 58. The end of housing 52 is shaped to accommodate the interior of lid 54.

The cross-section of dispenser 50 with lid 54 removed is illustrated in FIG. 10, view (a) the cross-section being taken through a section of the dispenser exposing an aperture 76 formed in conduit 74. As can be seen from FIG. 10, view (a) reservoir 68 is enclosed in housing 52. Housing 52 has an aperture 53 at an end opposite the valve member 58. Valve member 58 is "press fitted" to housing 52 comprises clips 59 to act as stops against the side walls of housing 52. Housing 52 may also be slightly tapered so the insertion of the valve member 58 move the sides of the housing 52 apart against the bias of the deformable material in order to engage a push fit. Optionally, the push fit may comprise a snap fit arrangement with mutually complementary inter-engagement members for attaching valve 58 firmly to housing 52.

The interior cavity 71 of reservoir 68 is where liquid is stored. Valve member 58 includes a conduit 74 which is in liquid communication with outlet 60. Conduit 74 extends through moulded spring 70, which is mounted to the edge of neck 72 and continues through neck 72 of reservoir 68 into the storage cavity 71. The end of conduit 74 extending into the storage cavity 71 is closed at an end wall and includes an aperture, 76, in a side wall towards the closed end. In the valve closed configuration as illustrated in FIG. 10, view (a) helical spring 70 biases reservoir 68 towards the far end of the cavity 52 which acts as a stop member for the reservoir 68.

Just below neck 72 of reservoir 68 is disposed a seal arrangement 78, 80 and 81. The seal arrangement is such that in the valve closed position liquid communication between the storage cavity 71 and aperture 76 is inhibited. As can be seen from reference 80 of the seal arrangement a small section, 81, protrudes under the closed end of conduit 74. Seal arrangement 78, 80 and 81 forms a concentric ring comprised of region 81 protruding under the closed end of conduit 74 when the valve is closed and widening out in a circular cone-like configuration towards the interior of storage cavity 71. The seal arrangement, at least in region 81, comprises a resiliently deformable material such as rubber or silicone. The resiliently deformable region 81 is configured so that it is biased towards the closed end of conduit 74 but may be urged back towards the cavity when conduit 74 is inserted into the cavity such as when the valve is opened.

Referring now to FIG. 10, view (b) conduit 74 has been urged into cavity 71 and region 81 can be seen to have been deformed by the movement of conduit 74, from its closed to open position. Moving conduit 74 to the open position brings aperture 76 into liquid communication with storage cavity 71 thereby providing a liquid communication path from storage cavity 71 through the tubular interior of conduit 74 to outlet 60.

Conduit 74 is urged into storage cavity 71 by movement of reservoir 68 towards valve member 58 against the bias of moulded spring 70. Movement of reservoir 68 from the valve closed position to the valve open position is achieved by the action of abutment member 82. Abutment member 82 extends from the interior top of lid 54 into the interior cavity of lid 54. When lid 54 is placed over the non-outlet end of housing 52 abutment member 82 passes through aperture 53 in the end of housing 52 to abut an exterior end wall of reservoir 68. As lid 54 is urged over the end of housing 52 reservoir 68 is moved against the bias of helical spring 70 such that conduit 74 deforms the seal arrangement in region 81 and enters storage cavity 70. Removal of lid 54 from the end of housing 52 results in reservoir 68 being urged back and away from valve member 58 and with the bias of moulded spring 70 such that conduit 74 moves out of the storage cavity 71. The deformable region 81 of the seal arrangement relaxes back to protrude under the closed end of conduit 74 thereby inhibiting liquid communication between storage cavity 71 and aperture 76 to close the valve member 58.

In a particular embodiment abutment member 82 may be cylindrical and configured to accommodate outlet 60 in its interior thereby to provide further protection against contents of the dispenser.

FIG. 11 illustrates a seal arrangement suitable for outlet 5 of the dispenser illustrated in FIGS. 1 to 6. FIG. 11, view (a) shows the arrangement 100 in a closed configuration in which stopper 102 is engaged with the interior hollow tube of conduit 104 to inhibit liquid communication into conduit. Movement of the conduit 104 away from the stopper opens the outlet 100 as illustrated in FIG. 11, view (b) and permits liquid, 106, to flow around the stopper and into the hollow tube conduit 104 comments out of the outlet. Another example of a seal arrangement suitable for the dispenser illustrated in FIGS. 1 to 6 is illustrated in FIG. 12. The arrangement, 110, comprises a conduit 114 having a hollow section engaging with the stopper 112 when shut. To open the outlet the conduit 114 is moved away such that liquid 106 the flow around stopper 112 and out of the outlet.

As used herein any reference to "one embodiment" or "an embodiment" means that a particular element, feature, structure, or characteristic described in connection with the embodiment is included in at least one embodiment. The appearances of the phrase "in one embodiment" or the phrase "in an embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the invention. This is done merely for convenience and to give a general sense of the invention. This description should be read to include one or at least one and the singular also includes the plural unless it is obvious that it is meant otherwise.

In view of the foregoing description it will be evident to a person skilled in the art that various modifications may be made within the scope of the invention. For example, the embodiment of a dispenser in accordance with the present invention has been described with reference to a moulded helical spring. However, the spring need not be moulded but may be a conventional helical spring made of wire. Optionally, or additionally, the spring may be a leaf spring or some other resilient member configured to bias the reservoir 68 away from valve member 58. Although polypropylene has been provided as an example of material for which the dispenser may be made, other plastics materials or other suitable material such as a resin may also be utilised.

The scope of the present disclosure includes any novel feature or combination of features disclosed therein either explicitly or implicitly or any generalisation thereof irrespective of whether or not it relates to the claimed invention or mitigate against any or all of the problems addressed by the present invention. The applicant hereby gives notice that new claims may be formulated to such features during prosecution of this application or of any such further application derived therefrom. In particular, with reference to the appended claims, features from dependent claims may be combined with those of the independent claims and features from respective independent claims may be combined in any appropriate manner and not merely in specific combinations enumerated in the claims.

The invention claimed is:

1. A dispenser for dispensing a liquid, comprising:

a reservoir for liquid, the reservoir deformable to permit pressure to be exerted on a liquid in the reservoir, the reservoir comprising:

a bottom wall and a top wall;

wherein the top wall includes a tubular guide member extending from an exterior into an interior of the reservoir;

a first aperture in a wall of the tubular guide member disposed in the interior of the reservoir;

a conduit assembly including:

a conduit with an outlet for dispensing a liquid; and a second aperture in a wall of the conduit;

wherein the conduit is received in the tubular guide member to provide liquid communication between the reservoir and the outlet;

wherein the conduit assembly and reservoir are movable with respect to each other between a first configuration in which the conduit wall occludes the first aperture such that the reservoir is not in liquid communication with the outlet, and a second configuration in which, through alignment of the first and second apertures, the reservoir is in liquid communication with the outlet, the tubular guide member for guiding movement of the conduit between the first and second configurations;

a closure, including an engagement member disposed on the interior of the closure, engageable with the dispenser and movable between a closed position in which the outlet is occluded by the engagement member and an open position in which the outlet is not occluded;

a deformable housing for receiving the reservoir, the reservoir translatable with respect to the housing to bring the reservoir into liquid communication with the outlet; and wherein the engagement member of the closure, while in the outlet non-occluded position, is engageable, through an aperture in a bottom of the housing, with the reservoir bottom for urging the conduit and reservoir from the first configuration to the second configuration for bringing the reservoir into liquid communication with the outlet and for maintaining the reservoir in liquid communication with the outlet to enable the liquid to be dispensed when pressure is exerted on the housing and the reservoir.

2. A dispenser according to claim 1, wherein the reservoir and conduit are slideably movable with respect to each other between the first and second configuration.

3. A dispenser according to claim 1, wherein an end of the conduit comprises the outlet.

4. A dispenser according to claim 1, wherein the arrangement is constrained to be movable between the first and second configuration only while the closure is in the outlet non-enclosed position.

5. A dispenser according to claim 1, wherein the closure is configured to engage with the reservoir for removably retaining the closure in a closed outlet position.

6. A dispenser according to claim 1, wherein the closure and the reservoir comprise mutually cooperative engagement formations configured for removably retaining the closure in a closed outlet position.

7. A dispenser according to claim 1, wherein the closure is configured to engage with the housing for removably retaining the closure in a closed outlet position.

8. A dispenser according to claim 1, further comprising a bias mechanism configured to bias the reservoir away from the second configuration.

9. A dispenser according to claim 6, wherein the mutually cooperative engagement formations comprise a detent arrangement movable between an engaged and disengaged position, wherein in the engaged position the closure is retained in the closed outlet position and in the disengaged position the closure is movable to the outlet non-enclosed position.

* * * * *